US007098416B2

(12) United States Patent
Puhalla et al.

(10) Patent No.: US 7,098,416 B2
(45) Date of Patent: Aug. 29, 2006

(54) REVERSE-ACTION AUXILIARY SWITCH ACTUATOR MECHANISM AND CIRCUIT BREAKER EMPLOYING THE SAME

(75) Inventors: Craig J. Puhalla, Moon Township, PA (US); David C. Turner, Imperial, PA (US); Raymond P. Gundy, II, Indiana, PA (US); Percy J. Lipsey, II, Coraopolis, PA (US); Jorge E. Tongo, H. Matamoros (MX)

(73) Assignee: Eaton Corporation, Cleveland, OH (US)

( * ) Notice: Subject to any disclaimer, the term of this patent is extended or adjusted under 35 U.S.C. 154(b) by 27 days.

(21) Appl. No.: 11/043,840

(22) Filed: Jan. 25, 2005

(65) Prior Publication Data

US 2006/0163049 A1 Jul. 27, 2006

(51) Int. Cl.
*H01H 3/20* (2006.01)

(52) U.S. Cl. ..... 200/330; 200/400; 200/402; 200/48 R; 335/18; 335/198; 361/42

(58) Field of Classification Search ..... 200/330–334, 200/400–402, 47, 48 R; 335/78, 175, 186, 335/18, 8–10, 197–198; 361/42–50
See application file for complete search history.

(56) References Cited

U.S. PATENT DOCUMENTS 4,211,989 A * 7/1980 Acampora ..... 335/17
4,707,674 A 11/1987 Harper
5,449,871 A * 9/1995 Batteux et al. ..... 200/401
5,552,755 A 9/1996 Fello et al.
6,072,136 A * 6/2000 Wehrli et al. ..... 200/401
6,337,449 B1 * 1/2002 Brouillat et al. ..... 200/400
6,441,328 B1 * 8/2002 Matejka et al. ..... 200/330

OTHER PUBLICATIONS

U.S. Appl. No. 10/650,342, is Now U.S. Appl. No. 6,903,289.
U.S. Appl. No. 10/693,769, is Now U.S. Appl. No. 6,812,423.

* cited by examiner

*Primary Examiner*—Richard K. Lee
(74) *Attorney, Agent, or Firm*—Martin J. Moran

(57) ABSTRACT

An auxiliary switch actuating mechanism is for a circuit breaker including a housing, separable contacts, an operating mechanism with an operating handle interconnected to the separable contacts by a linkage assembly, and an auxiliary switch having a contact member. The auxiliary switch actuating mechanism includes an actuating lever with first and second ends and a pivot portion engaging the housing proximate the auxiliary switch. A torsion spring biases the actuating lever towards engaging and actuating the contact member of the auxiliary switch. The contact member is actuated when the separable contacts are not tripped open and the linkage assembly is not collapsed. When the circuit breaker trips, the linkage assembly collapses, engaging and pivoting the actuating lever, in order to overcome the bias and disengage and deactivate the contact member.

18 Claims, 6 Drawing Sheets

REVERSE-ACTION AUXILIARY SWITCH ACTUATOR MECHANISM AND CIRCUIT BREAKER EMPLOYING THE SAME

BACKGROUND OF THE INVENTION

1. Field of the Invention

The present invention relates generally to electrical switching apparatus and, more particularly, to an auxiliary switch actuator mechanism for a circuit breaker. The invention also relates to circuit breakers employing an auxiliary switch actuator mechanism.

2. Background Information

Circuit breakers having auxiliary switches are generally old and well known in the art. Typically, the auxiliary switch is electrically connected with a circuit including a status indicator (e.g., an audible alarm, such as a bell, or a visual indicator, such as a light) for providing a remote indication of the condition of the circuit breaker. Some auxiliary switches provide different outputs for each of the three general circuit breaker conditions, OFF, ON, and tripped. Other auxiliary switches only provide an indication when the circuit breaker has tripped.

The design and configuration of auxiliary switches, which will be discussed in further detail herein, is substantially uniform and unchanging throughout the industry. While this is advantageous from the standpoint of establishing an industry standard, it is disadvantageous in that there is a lack of variation in switch design making it difficult to accommodate the differing requirements of various switching applications. For example, the microswitch or internal contacts of most known auxiliary switches are not actuated unless the circuit breaker is tripped. In certain applications, it is desirable to have the opposite situation, with the microswitch being activated until the breaker trips. Known auxiliary switch designs, alone, cannot accommodate these circumstances. Therefore, in order to achieve the desired auxiliary switch operation, it has been necessary to make modifications to the internal components of the circuit breaker. Accordingly, known circuit breaker designs have begun to incorporate auxiliary switch actuating mechanisms.

For example, U.S. Pat. No. 4,707,674 discloses a representative auxiliary switch actuator mechanism of the type shown in FIGS. 1 and 2. FIG. 1 shows a circuit breaker 2 and the auxiliary switch actuating mechanism 4 therefor. FIG. 2 shows certain elements of the actuating mechanism 4 in greater detail.

Generally, when the circuit breaker handle 6 is moved from the OFF position (not shown) to the ON position, as shown in FIG. 1, a breaker mechanism 8 acts on a movable contact arm 10 causing it to pivot about the pivot axis defined by mounting pin 12. In response, a movable contact 14 on the contact arm 10 engages a fixed contact 16, as shown. As the contact arm 10 pivots, the bottom surface 18 thereof engages actuator arm 20 causing actuator member 22 to pivot about the axis defined by mounting pin 24, against a spring-bias exerted by an internal contact (not shown) of auxiliary switch 26. The internal contact (not shown) is coupled to movable pin 28 and is actuated thereby. As the actuator member 22 continues to move, the end of it opposite pin 24 slides past shoulder 30 of locking member 32 (see also FIG. 2).

A spring 34 biases the locking member 32 counterclockwise (with respect to FIG. 1) about pin 12, which results in shoulder 30 overlapping the upper surface 36 of base plate 38 at this location, thereby forming a stop which prevents movement of actuator member 22. Additionally, finger 40 engages the back edge 42 (FIG. 2) of slot 44 (FIG. 2) in actuator member 22 thus limiting the counterclockwise motion of locking member 32. In this manner, the auxiliary switch 26 is held in the actuated position until the shoulder 30 of locking arm 46 is moved out of engagement with the actuator member 22.

Typically, the auxiliary switch 26 has three contact terminals including a common ("C") terminal 48 proximate the line side of the circuit breaker 2, a normally closed ("NC") terminal 50 proximate the opposite or load side of the circuit breaker 2, and a generally central normally open ("NO") terminal 52. Current flows through the auxiliary switch 26 between the C terminal 48 and one of the NC and NO terminals 50,52. When the circuit breaker 2 is turned ON (FIG. 1), the circuit through the main breaker contacts 14,16 is closed and the actuator member 22 sets the auxiliary switch 26, as previously discussed. This represents the actuated state of the auxiliary switch 26 in which the circuit between the C and NO terminals 48,52 is closed. However, as disclosed in U.S. Pat. No. 4,707,674, the auxiliary switch 26 could be operated in the opposite manner (e.g., with the C terminal 48 being electrically connected to the NC terminal 50 when the main breaker contacts 14,16 are closed).

When the circuit breaker handle 6 is manually moved between the ON and OFF positions, a sear pin 54 engages the link members of the breaker mechanism 8 in order to prevent them from collapsing. The breaker mechanism 8 remains engaged and locked by the sear pin 54 as the handle 6 pivots counterclockwise (with respect to FIG. 1) from the ON position (FIG. 1) toward the OFF position (not shown). In other words, when the circuit breaker handle 6 is manually operated, the sear pin 54 follows a first path of travel which avoids contact with second arm 56 of locking member 32. As movable contact arm 10 pivots upward, counterclockwise about pin 12, movable contact 14 disengages fixed contact 16 in order to open the main circuit. This also releases the force exerted by moveable contact arm 10 on pin 28 of auxiliary switch 26 through actuator arm 20 of actuator member 22. Normally, in the absence of any restraint on actuator member 22, the bias on moveable pin 28 exerted by the internal spring (not shown) of the auxiliary switch 26 would cause the internal contact to be returned to the NC position. However, this is prevented by the action of locking member 32. Specifically, the shoulder 30 of arm 46 acts as a stop against base plate 38 of actuator member 22 in order to restrain the bias thereof caused by the auxiliary switch internal contact (not shown) through movable pin 28 (best shown in FIG. 1). Therefore, when the circuit breaker 2 is manually opened, the auxiliary switch 26 remains actuated, with the NO contact closed.

Conversely, when a trip condition causes the circuit breaker 2 to trip, the armature 58 (FIG. 1) pivots causing the sear pin 54 to pivot and release allowing it to collapse the linkage of breaker mechanism 8 thereby separating contacts 14,16 and opening the main circuit. This collapse releases the sear pin 54 causing it to move in a second path of travel in which it contacts the second arm 56 of locking member 32. As the sear pin 54 continues to move, it causes locking member 32 to rotate clockwise (with respect to FIG. 1) about pin 12, against the spring-bias generated by spring 34. Then, shoulder 30 disengages base plate 38, releasing the actuator member 22 and allowing movable pin 28 of the auxiliary switch 26 to move outwardly in accordance with the bias provided by internal spring contact (not shown) in order that the auxiliary switch 26 switches from the actuated state to the non-actuated state. Therefore, an alarm circuit (not shown) connected between the C and NC terminals 48,50 of the auxiliary switch 26, is closed.

Despite the foregoing advancements in the art, significant disadvantageous remain. For example, the aforementioned auxiliary switch actuating mechanism is complex, requires numerous separate components and demands that all of the components interact precisely in order to function properly. For example, the shoulder and slot features and multiple interacting components previously discussed, could slip, become misaligned, or otherwise fail to interact correctly. Additionally, such an actuating mechanism requires the auxiliary switch to be modified, for example, to include a molded projection (FIGS. 1 and 2) with openings to receive mounting pin 24 about which actuator member 22 pivots.

There is a need, therefore, for a simplified auxiliary switch actuating mechanism which is capable of reversing the operation of a standard auxiliary switch, without requiring the auxiliary switch to be modified.

There is, therefore, room for improvement in auxiliary switch actuating mechanisms and in circuit breakers employing an auxiliary switch actuating mechanism.

SUMMARY OF THE INVENTION

These needs and others are satisfied by the present invention, which is directed to a reverse-action auxiliary switch actuating mechanism for a circuit breaker. The circuit breaker includes a spring-biased actuating assembly in order to normally actuate the auxiliary switch when the circuit breaker is ON or OFF. The spring-bias is overcome when the breaker trips resulting in operation (e.g., actuation of a status indication such as an audible alarm or visual light) which is opposite the normal operation of a standard auxiliary switch. In other words, the present invention, through the design of an actuating mechanism for the circuit breaker, reverses the operation of the auxiliary switch.

As one aspect of the invention, an auxiliary switch actuating mechanism is for an electrical switching apparatus including a housing enclosing separable contacts, an operating mechanism including an operating handle protruding from the housing and structured to open and close the separable contacts, a linkage assembly interconnecting the operating handle and the separable contacts and moving between a set position corresponding to the separable contacts not being tripped open, and a collapsed position corresponding to the separable contacts being tripped open, an actuator structured to collapse the linkage assembly in response to a trip condition, and an auxiliary switch having a contact member. The auxiliary switch actuating mechanism comprises: an actuating lever including a first end and a second end, the actuating lever structured to be pivotally coupled within the housing proximate the auxiliary switch; and a bias member structured to bias the actuating lever towards engaging the contact member of the auxiliary switch, wherein the first end of the actuating lever is structured to engage and actuate the contact member of the auxiliary switch in accordance with the bias when the separable contacts are not tripped open and the linkage assembly is in the set position, and wherein the second end of the actuating lever is structured to be engaged and pivoted by the linkage assembly when the separable contacts are tripped open in response to the tripping condition and the linkage assembly is in the collapsed position, in order that the actuating lever overcomes the bias and disengages and deactivates the contact member of the auxiliary switch.

The linkage assembly may include a U-shaped link and the second end of the actuating lever may include a paddle. The paddle may be structured to be engaged by the U-shaped link when the separable contacts are tripped open and the linkage assembly collapses, in order to pivot the actuating lever and overcome the bias causing the second end of the actuating lever to disengage and deactivate the contact member of the auxiliary switch.

The actuating lever may be a single-piece molded member. The housing may be a two-piece molded housing having a first half and a second half, the actuating lever may include a pivot portion, and the first and second halves of the molded housing may include a receptacle wherein the pivot portion is structured to pivotally engage the receptacle.

As another aspect of the invention, a circuit breaker comprises: a housing; separable contacts enclosed within the housing; an operating mechanism including an operating handle for opening and closing the separable contacts, the operating handle protruding from the housing, a linkage assembly interconnecting the operating handle and the separable contacts, the linkage assembly moving between a set position corresponding to the separable contacts not being tripped open and a collapsed position corresponding to the separable contacts being tripped open, and an actuator structured to collapse the linkage assembly in response to a trip condition; an auxiliary switch having a contact member; and an auxiliary switch actuating mechanism comprising: an actuating lever including a first end and a second end, the actuating lever pivotally coupled within the housing proximate the auxiliary switch, and a bias member biasing the actuating lever towards engaging the contact member of the auxiliary switch, wherein the first end of the actuating lever engages and actuates the contact member in accordance with the bias when the separable contacts are not tripped open and the linkage assembly is in the set position, and wherein the second end of the actuating lever is engaged and pivoted by the linkage assembly when the separable contacts are tripped open in response to the tripping condition and the linkage assembly is in the collapsed position, in order that the actuating lever overcomes the bias and disengages and deactivates the contact member of the auxiliary switch.

The housing may further include a pivot securing the bias member, which may be a torsion spring, thereto.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
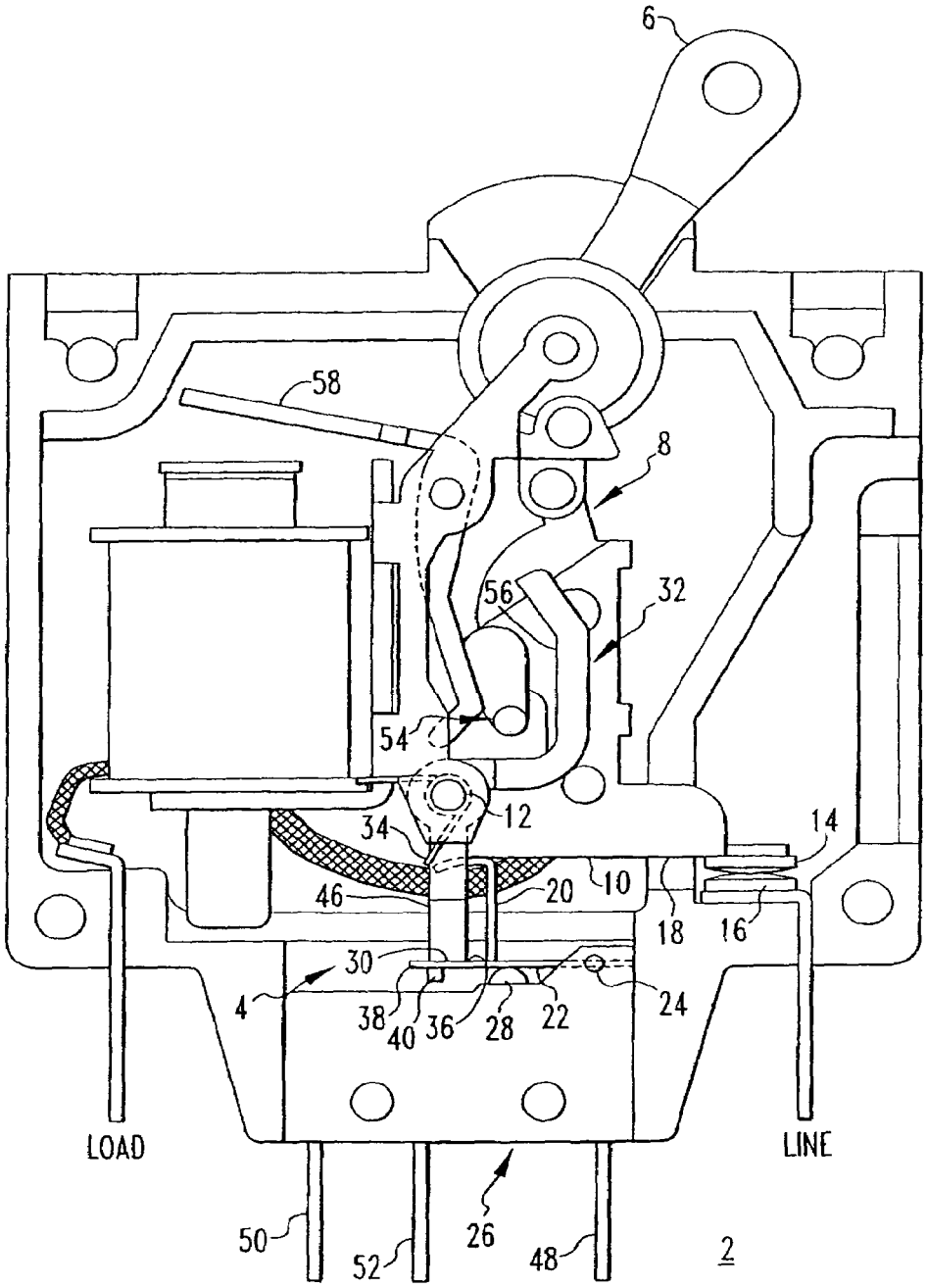
FIG. 1 PRIOR ART
FIG. 1 is a cross-sectional side view of a circuit breaker and auxiliary switch actuating mechanism therefor, with the circuit breaker shown in the ON position and the auxiliary switch activated.

For purposes of illustration, the invention will be described as applied to a hydraulic-magnetic circuit breaker, although it will become apparent that it could also be applied to other types of circuit breakers (e.g., hydraulic circuit breakers; non-hydraulic circuit breakers) and other electrical switching apparatus, generally (e.g., without limitation, circuit switching devices and other circuit interrupters such as contactors, motor starters, motor controllers and other load controllers).

Directional phrases used herein, such as, for example, top, bottom, left, right, clockwise, counterclockwise and derivatives thereof, relate to the orientation of the elements in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "trip condition" refers to any abnormal electrical condition causing a circuit breaker to trip and expressly includes, without limitation, an overcurrent condition, an overload condition, an arc fault condition, a ground fault condition, an undervoltage condition, or a relatively high level short circuit or fault condition.

Figure 3:
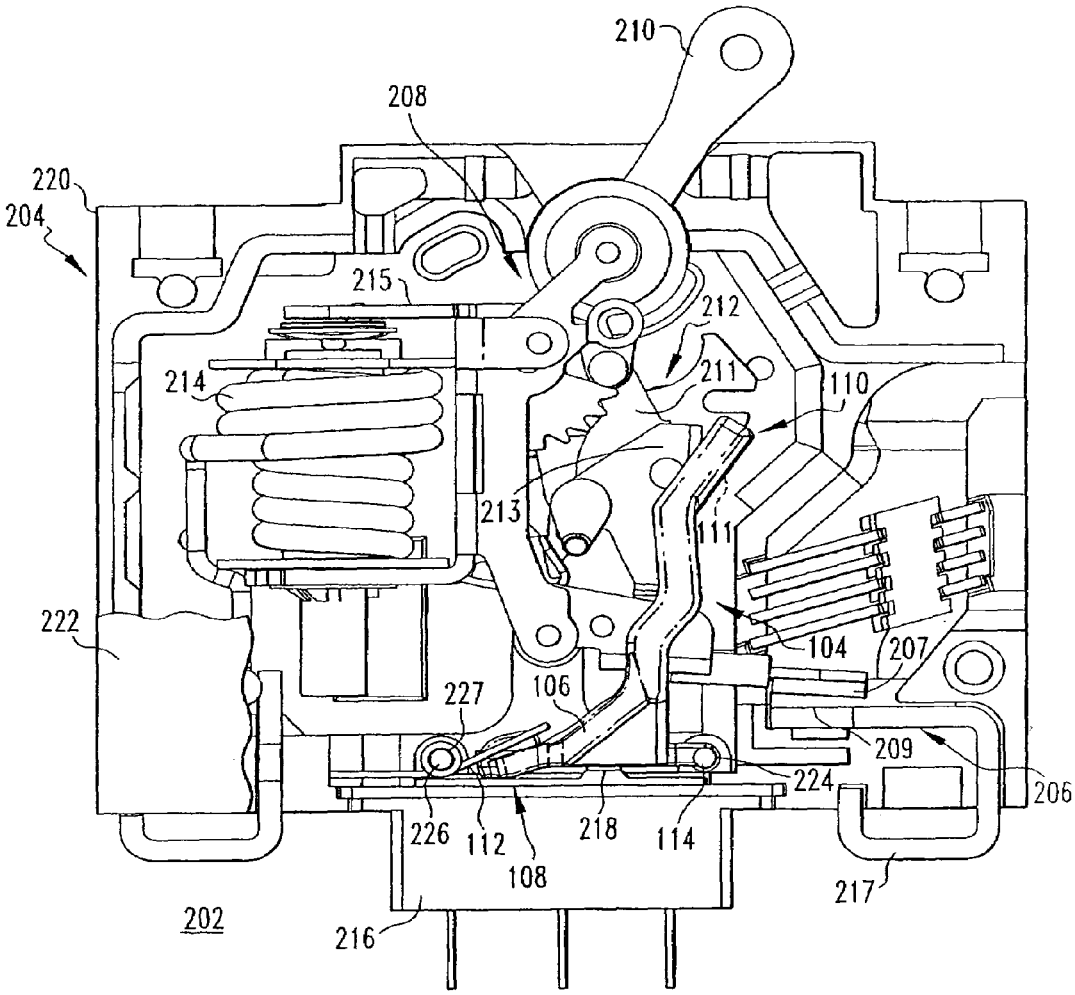
FIG. 3 is a cross-sectional side view of a hydraulic-magnetic circuit breaker employing an auxiliary switch actuating mechanism therefor in accordance with the present invention, with the circuit breaker in the ON position and the auxiliary switch actuated.

FIG. 3 shows an auxiliary switch actuating mechanism 104 for an electrical switching apparatus, such as the hydraulic-magnetic circuit breaker 202, shown. The circuit breaker 202 includes a housing 204. In the example of FIG. 3, the housing is a two-piece molded housing 204 having first and second halves 220,222. The housing 204 encloses separable contacts 206 (shown in the closed position in FIG. 3). The circuit breaker 202 further includes an operating mechanism 208, an auxiliary switch 216 and the exemplary auxiliary switch actuating mechanism 104.

Figure 2:
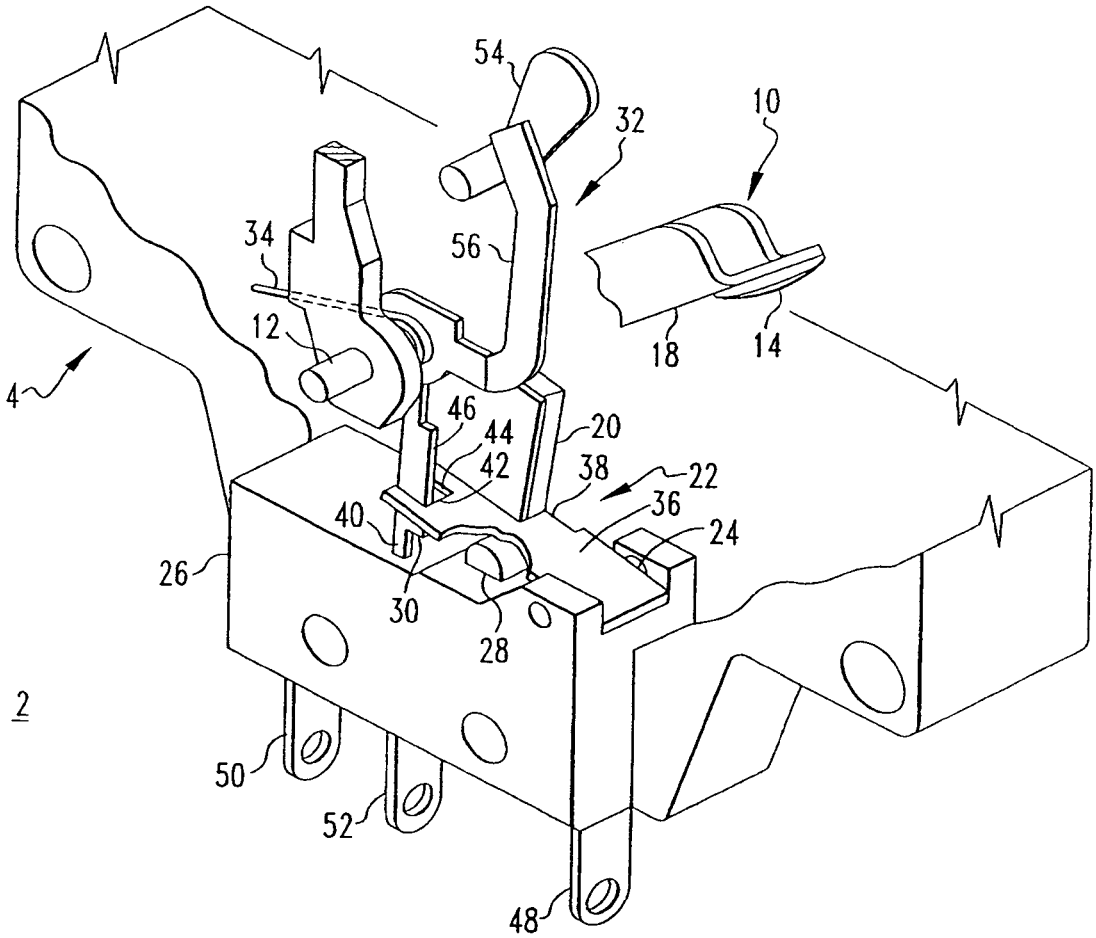
FIG.2 PRIOR ART
FIG. 2 is an isometric view of the circuit breaker and auxiliary switch actuating mechanism of FIG. 1 modified to show the auxiliary switch in the unactuated state and with portions of the circuit breaker cut away for ease of illustration.

The example operating mechanism 208 is similar in configuration and function to breaker mechanism 8 illustrated and discussed previously with respect to FIGS. 1 and 2. Specifically, the operating mechanism 208 includes an operating handle 210 which protrudes from the housing 204 and is structured to open and close the separable contacts 206. A linkage assembly 212 interconnects the base of the operating handle 210 and the separable contacts 206. More precisely, the separable contacts 206 include a moveable contact 207 and a stationary contact 209. The stationary contact 209 is in electrical communication with a terminal 217, for example on the load side of the circuit breaker 202. The moveable contact 207 is mechanically interconnected with the operating handle 210 by linkage assembly 212 and is structured to move in accordance therewith between a first position in which the moveable and stationary contacts 207,209 contact one another (FIG. 3) and a second position in which they are spaced apart (not shown). The exemplary linkage assembly 212 includes a first link 211 and a second or U-shaped link 213 which links are structured to collapse in response to a trip condition. The details of this collapse are substantially similar to those previously discussed in connection with the link components of breaker mechanism 8 of FIGS. 1 and 2.

Figure 4:
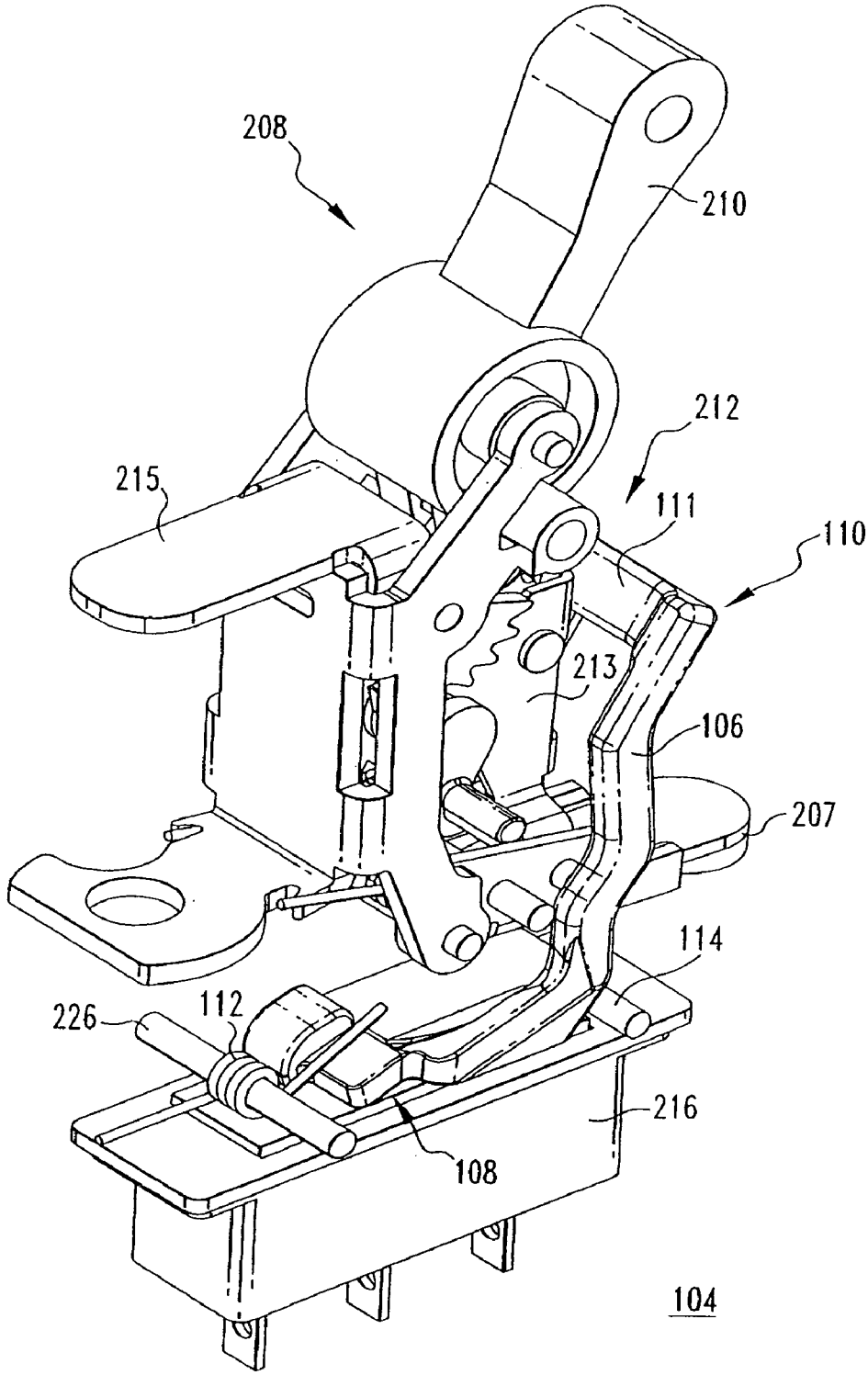
FIG. 4 is an isometric view of the operating assembly and auxiliary switch actuating mechanism of FIG. 3.
Figure 5:
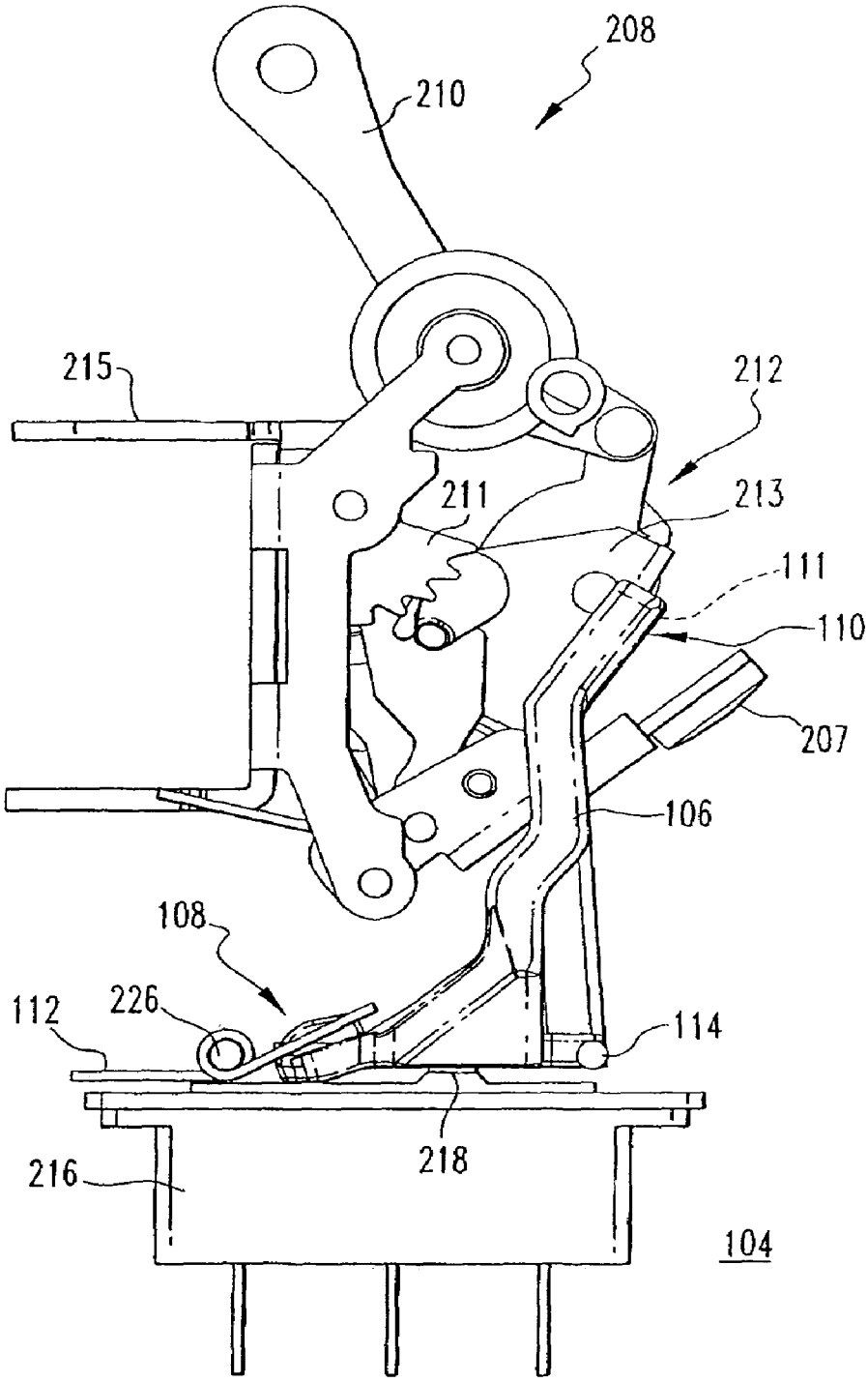
FIG. 5 is a side view of the operating assembly and auxiliary switch actuating mechanism of FIG. 4, modified to show the operating assembly and auxiliary switch actuating mechanism in their OFF positions.
Figure 6:
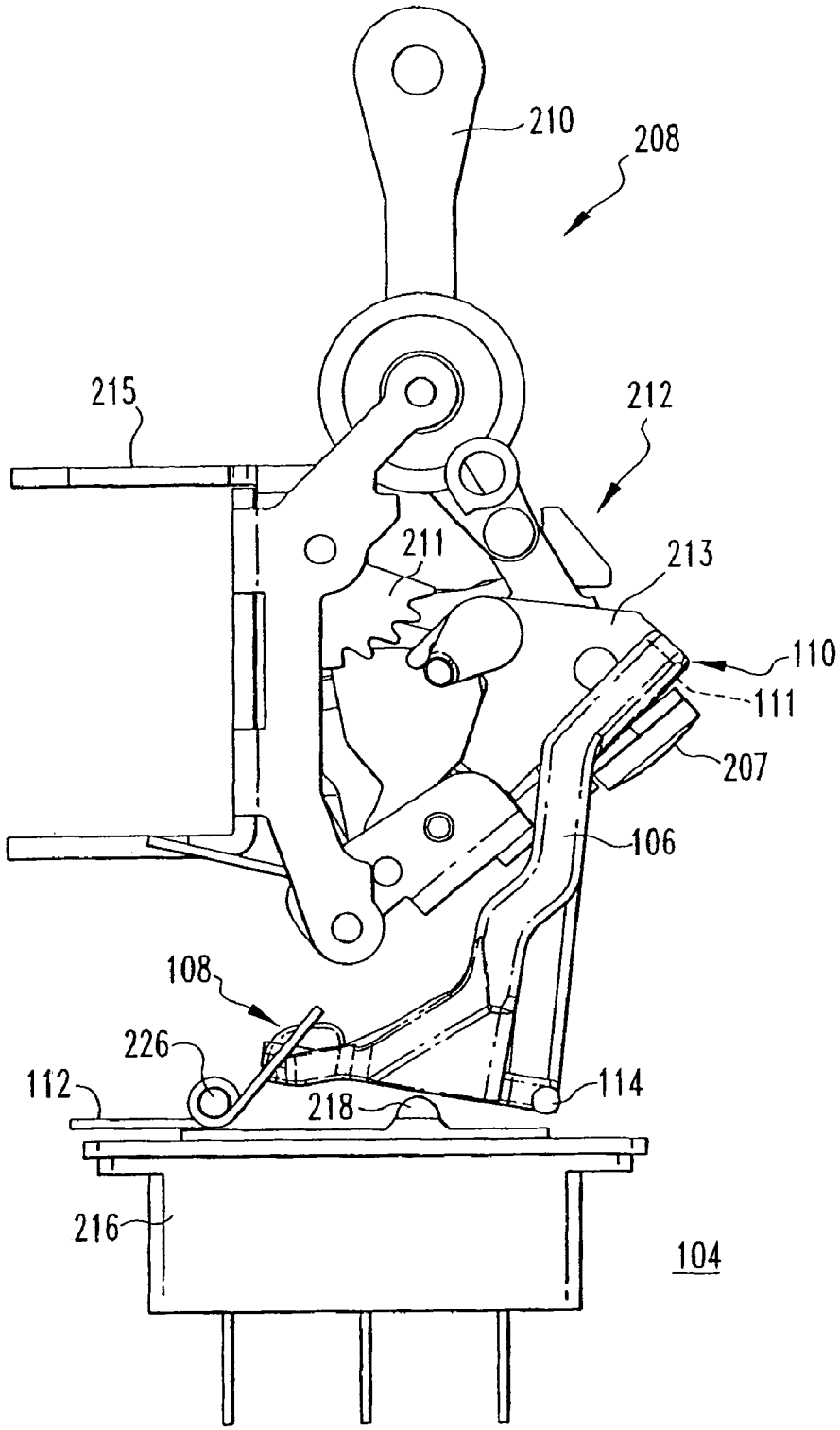
FIG. 6 is a side view of the operating assembly and auxiliary switch actuating mechanism of FIG. 4 modified to show the operating assembly and auxiliary switch actuating mechanism in their tripped positions.

In operation, when the linkage assembly 212 collapses, the U-shaped link 213 engages and pivots the exemplary auxiliary switch actuating mechanism 104, as will be discussed in further detail below. Specifically, the linkage assembly 212 moves between a set position (see, e.g. FIGS. 3–5) corresponding to the separable contacts 206 not being tripped open, and a collapsed position (FIG. 6) corresponding the separable contacts 206 (only moveable contact 207 is shown in FIG. 6) being tripped open. An actuator, such as a solenoid 214, initiates the collapse of the linkage assembly 212. More specifically, the operating mechanism 208 includes an armature 215 which is actuated and moved by the solenoid 214 or other suitable actuator, in a known manner (e.g., as was discussed above in connection with the armature 58 and sear pin 54 of FIG. 1), in response to the trip condition, thereby releasing the linkage assembly 212 and allowing it to collapse.

As shown in FIGS. 3–6, the auxiliary switch actuating mechanism 104 includes an actuating lever 106 having a first end 108 and a second end 110. The actuating lever 106 is pivotally coupled within the circuit breaker housing 204 proximate the auxiliary switch 216. Specifically, the exemplary actuating lever 106 is a single-piece molded member including a pivot portion 114, such as the integrally formed molded pin between the first and second ends 108, 110 of the actuating lever 106 of FIGS. 3–6. The pivot portion 114 engages a receptacle 224 or molded socket (FIG. 3) in the interior of the housing 204. In the example of FIG. 3, the molded pin projection pivot portion 114 is pivotally received within receptacles 224 in each of the first and second halves 220,222 of the exemplary two-piece molded housing 204 (in FIG. 3, one receptacle 224 is shown in first half 220 of housing 204). It will be appreciated that the actuating lever 106 could alternatively be pivotally secured to the housing 204 in any known or suitable manner other than the exemplary molded pin 114 and receptacle 224 arrangement. For example, without limitation, a fastener (not shown) and sleeve (not shown) combination could be employed to pivotally secure the actuating lever 106 within the housing 204.

A bias member, such as the torsion spring 112 shown in FIGS. 3–6, biases the first end 108 of the actuating lever 106 towards engaging a contact member 218 of the auxiliary switch 216. As was previously discussed in connection with moveable pin 28 of auxiliary switch 26 of FIGS. 1 and 2, the contact member 218 moves between an actuated position (FIGS. 3–5) in which the circuit between the auxiliary switch NO and C contacts is closed, and a second, non-actuated position (FIG. 6) in which the contact member 218 is not depressed and the circuit between the auxiliary switch NC and C contacts is closed.

In operation, when the separable contacts 206 are not tripped open and the linkage assembly 218 is in the set position (FIGS. 3–5), the first end 108 of the actuating lever 106 engages and actuates the contact member 218 in accordance with the bias of the spring 112. When the separable contacts 206 are tripped open in response to the tripping condition and the linkage assembly 212 is released and allowed to collapse to the collapsed position (FIG. 6), the second end 110 of the actuating member 106 is engaged and pivoted by the linkage assembly 212 and, in particular, by the U-shaped link 213. In this manner, the actuating lever 106 overcomes the bias of the spring 112 and disengages and deactivates the contact member 218 of the auxiliary switch 216. To facilitate this interaction, the second end 110 of the exemplary actuating lever 106 includes a paddle 111 (best shown in FIG. 4) which is engaged by the U-shaped link 213 when the separable contacts 206 are tripped open and the linkage assembly 212 collapses (FIG. 6). In other words, the U-shaped link 213 engages the paddle 111 which causes the actuating lever 106 to pivot (clockwise with respect to FIG. 6) about pivot portion 114, thereby overcoming the bias applied to the first end 108 of the actuating lever 106 by torsion spring 112. Hence, the contact member 218 of the auxiliary switch 216 is disengaged and deactivated, as shown in FIG. 6.

As shown in FIGS. 3–6, the exemplary torsion spring 112 is secured to housing 204 (FIG. 3) by a pivot 226. The exemplary pivot 226 is a pin which is received through the coils of the torsion spring 112 and engages a receptacle 227 on at least one half (e.g., first half 220) of the circuit breaker housing 204 (FIG. 3). However, it will be appreciated that like the aforementioned pivotal engagement of the actuating lever pivot portion 114 with housing 204, the pivot 226 could alternatively be secured within the housing 204 by any known or suitable alternative mechanism (not shown).

It will also be appreciated that the auxiliary switch actuating mechanism 104 illustrated and discussed herein is but one representative embodiment contemplated by the present invention. Alternative shapes, sizes and configurations of the components of the mechanism such as, for example, the actuating lever 106, could be employed. For example, without limitation, the actuating lever 106 has been illustrated and discussed herein as being a single-piece molded member which is substantially rigid. While the exemplary molded member is made from, for example, plastic, it could alternatively be made from any known or suitable material (e.g., without limitation, metal). Additionally, this member is not required to be molded, but could alternatively be made from a different suitable manufacturing process. In summary, the shape, configuration and composition of the lever 106, which is shown and discussed herein, do not limit the scope of the invention.

Accordingly, the auxiliary switch actuating mechanism 104 of the present invention provides a mechanism for use with, for example, circuit breakers, in order to achieve desired auxiliary switch operating characteristics. Specifically, the invention provides a relatively simple method of operating an auxiliary switch and associated electrical circuits in a manner reversed from its standard operation (e.g., with the auxiliary switch being actuated when the circuit breaker is not tripped and non-actuated when the circuit breaker is tripped). The present invention accomplishes all of the foregoing without requiring modification to the auxiliary switch and through use of a minimal number of relatively simple components.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An auxiliary switch actuating mechanism for an electrical switching apparatus including a housing enclosing separable contacts, an operating mechanism including an operating handle protruding from said housing and structured to open and close said separable contacts, a linkage assembly interconnecting said operating handle and said separable contacts and moving between a set position corresponding to said separable contacts not being tripped open, and a collapsed position corresponding to said separable contacts being tripped open, an actuator structured to collapse said linkage assembly in response to a trip condition, and an auxiliary switch having a contact member, said auxiliary switch actuating mechanism comprising:

an actuating lever including a first end and a second end, said actuating lever structured to be pivotally coupled within said housing proximate said auxiliary switch; and a bias member structured to bias said actuating lever towards engaging said contact member of said auxiliary switch, wherein the first end of said actuating lever is structured to engage and actuate said contact member of said auxiliary switch in accordance with said bias when said separable contacts are not tripped open and said linkage assembly is in said set position, and wherein the second end of said actuating lever is structured to be engaged and pivoted by said linkage assembly when said separable contacts are tripped open in response to said tripping condition and said linkage assembly is in said collapsed position, in order that said actuating lever overcomes said bias and disengages and deactivates said contact member of said auxiliary switch.

2. The auxiliary switch actuating mechanism of claim 1 wherein said linkage assembly includes a U-shaped link; wherein the second end of said actuating lever includes a paddle; and wherein said paddle is structured to be engaged by said U-shaped link when said separable contacts are tripped open and said linkage assembly collapses, in order to pivot said actuating lever and overcome said bias causing the second end of said actuating lever to disengage and deactivate said contact member of said auxiliary switch.

3. The auxiliary switch actuating mechanism of claim 2 wherein said housing is a two-piece molded housing having a first half and a second half; wherein the first and second halves of said molded housing include a receptacle; wherein said actuating lever includes a pivot portion; and wherein said pivot portion is structured to pivotally engage said receptacle.

4. The auxiliary switch actuating mechanism of claim 1 wherein said actuator is a solenoid; wherein said operating mechanism includes an armature; and wherein said solenoid is adapted to actuate and move said armature in response to said trip condition causing said linkage assembly to collapse.

5. The auxiliary switch actuating mechanism of claim 1 wherein said bias member is structured to bias the first end of said actuating lever towards engaging said contact member of said auxiliary switch.

6. The auxiliary switch actuating mechanism of claim 1 wherein said bias member is a torsion spring.

7. The auxiliary switch actuating mechanism of claim 1 wherein said contact member of said auxiliary switch is operable between first and second positions corresponding to said auxiliary switch being actuated and non-actuated, respectively.

8. The auxiliary switch actuating mechanism of claim 1 wherein said actuating lever is a single-piece molded member.

9. A circuit breaker comprising:

a housing;

separable contacts enclosed within said housing;

an operating mechanism including an operating handle for opening and closing said separable contacts, said operating handle protruding from said housing, a linkage assembly interconnecting said operating handle and said separable contacts, said linkage assembly moving between a set position corresponding to said separable contacts not being tripped open and a collapsed position corresponding to said separable contacts being tripped open, and an actuator structured to collapse said linkage assembly in response to a trip condition;

an auxiliary switch having a contact member; and an auxiliary switch actuating mechanism comprising:

an actuating lever including a first end and a second end, said actuating lever pivotally coupled within said housing proximate said auxiliary switch, and a bias member biasing said actuating lever towards engaging said contact member of said auxiliary switch, wherein the first end of said actuating lever engages and actuates said contact member in accordance with said bias when said separable contacts are not tripped open and said linkage assembly is in said set position, and wherein the second end of said actuating lever is engaged and pivoted by said linkage assembly when said separable contacts are tripped open in response to said tripping condition and said linkage assembly is in said collapsed position, in order that said actuating lever overcomes said bias and disengages and deactivates said contact member of said auxiliary switch.

10. The circuit breaker of claim 9 wherein said linkage assembly includes a U-shaped link; wherein the second end of said actuating lever includes a paddle; and wherein said paddle is engaged by said U-shaped link when said separable contacts are tripped open and said linkage assembly collapses, in order to pivot said actuating lever and overcome said bias causing the second end of said actuating lever to disengage and deactivate said contact member.

11. The circuit breaker of claim 10 wherein said housing is a two-piece molded housing having a first half and a second half; wherein the first and second halves of said molded housing include a receptacle; wherein said actuating lever includes a pivot portion; and wherein said pivot portion pivotally engages said receptacle.

12. The circuit breaker of claim 9 wherein said actuator is a solenoid; wherein said operating mechanism includes an armature; and wherein said solenoid actuates and moves said armature in response to said trip condition, causing said linkage assembly to collapse.

13. The circuit breaker of claim 9 wherein said housing further includes a pivot securing said bias member thereto.

14. The circuit breaker of claim 9 wherein said bias member biases the first end of said actuating lever towards engaging said contact member of said auxiliary switch.

15. The circuit breaker of claim 9 wherein said bias member is a torsion spring.

16. The circuit breaker of claim 9 wherein said contact member of said auxiliary switch is operable between first and second positions corresponding to said auxiliary switch being actuated and non-actuated, respectively.

17. The circuit breaker of claim 9 wherein said actuating lever is a single-piece molded member.

18. The circuit breaker of claim 9 wherein said circuit breaker is a hydraulic-magnetic circuit breaker.

* * * * *